US006475060B1

(12) United States Patent
Liu

(10) Patent No.: US 6,475,060 B1
(45) Date of Patent: Nov. 5, 2002

(54) THREE-DIMENSIONAL BUILT-UP TOY TRAIN

(76) Inventor: Kuo-Ching Liu, 5Fl., No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 09/951,422

(22) Filed: Sep. 14, 2001

(51) Int. Cl.[7] ..... A63H 33/00
(52) U.S. Cl. ..... 446/487; 446/93
(58) Field of Search ..... 446/487, 480, 446/93, 94, 95; 434/259

(56) References Cited

U.S. PATENT DOCUMENTS 1,574,191 A * 2/1926 Groves ..... 446/94
2,035,624 A * 3/1936 Torme ..... 446/97
2,414,716 A * 1/1947 Carson
4,643,349 A * 2/1987 Sheffer ..... 446/488
4,807,802 A * 2/1989 Williams ..... 446/95
4,940,195 A * 7/1990 Jackson ..... 446/487
6,257,946 B1 * 7/2001 Yang ..... 446/93

* cited by examiner

*Primary Examiner*—Jacob K. Ackun
*Assistant Examiner*—Bena B. Miller
(74) *Attorney, Agent, or Firm*—Troxell Law Offices PLLC

(57) ABSTRACT

A three-dimensional toy train is built-up from a plurality of modeled flat parts that are directly stamped on a thin plate for forming a front locomotive, a back locomotive and a plurality of passenger cards. The modeled flat parts are provided at predetermined positions with slits of predetermined depths, so that the flat parts are connected through engagement of these slits with one another in different ways. A player is trained to employ imagination and thinking ability in the process of connecting the modeled flat parts to form the toy train.

3 Claims, 5 Drawing Sheets

THREE-DIMENSIONAL BUILT-UP TOY TRAIN

FIELD OF THE INVENTION

The present invention relates to a three-dimensional toy train built up from a plurality of modeled flat parts, each of which being provided at predetermined positions with slits to enable connection of the modeled flat parts through engagement of the slits with one another to form locomotive and cars of the toy train. And, a player is trained to employ imagination and thinking ability in the process of assembling the flat parts into the toy train.

BACKGROUND OF THE INVENTION

A conventional modeling toy usually includes a plurality of connectable parts and a manufacturer's instruction sheet. A player follows the instruction sheet to sequentially assemble the connectable parts into a complete model. In the process of assembling the modeling toy, the player is trained to employ his or her thinking and enjoys the fun of building up the toy. Glue is usually applied on the connectable parts to facilitate firm connection of the parts to one another. Once the conventional modeling toy is completed, it could not be disassembled for re-assembling and therefore brings only little fun to the player. Moreover, when the instruction sheet enables a player to assemble the connectable parts more easily, it also prevents the player to employ his or her free imagination and thinking ability in assembling the toy.

It is therefore tried by the inventor to develop a three-dimensional built-up toy train to eliminate drawbacks existing in the conventional built-up toys.

SUMMARY OF THE INVENTION

A primary object of the present invention is to provide a three-dimensional built-up toy train that allows a player to employ imagination and thinking ability in the process of assembling the toy train, and the toy train could be disassembled for re-building at any time.

To achieve the above and other objects, the present invention includes a plurality of modeled flat parts directly stamped on a thin plate for assembling into a front locomotive, a back locomotive, and a plurality of two-section passenger cars. The modeled flat parts are provided at predetermined positions with slits having predetermined depths to enable connection of the modeled flat parts through engagement of the slits with one another. A player may employ her or her free imagination and thinking ability to engage the slits on different modeled flat parts in different ways, giving the completed toy train different appearance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
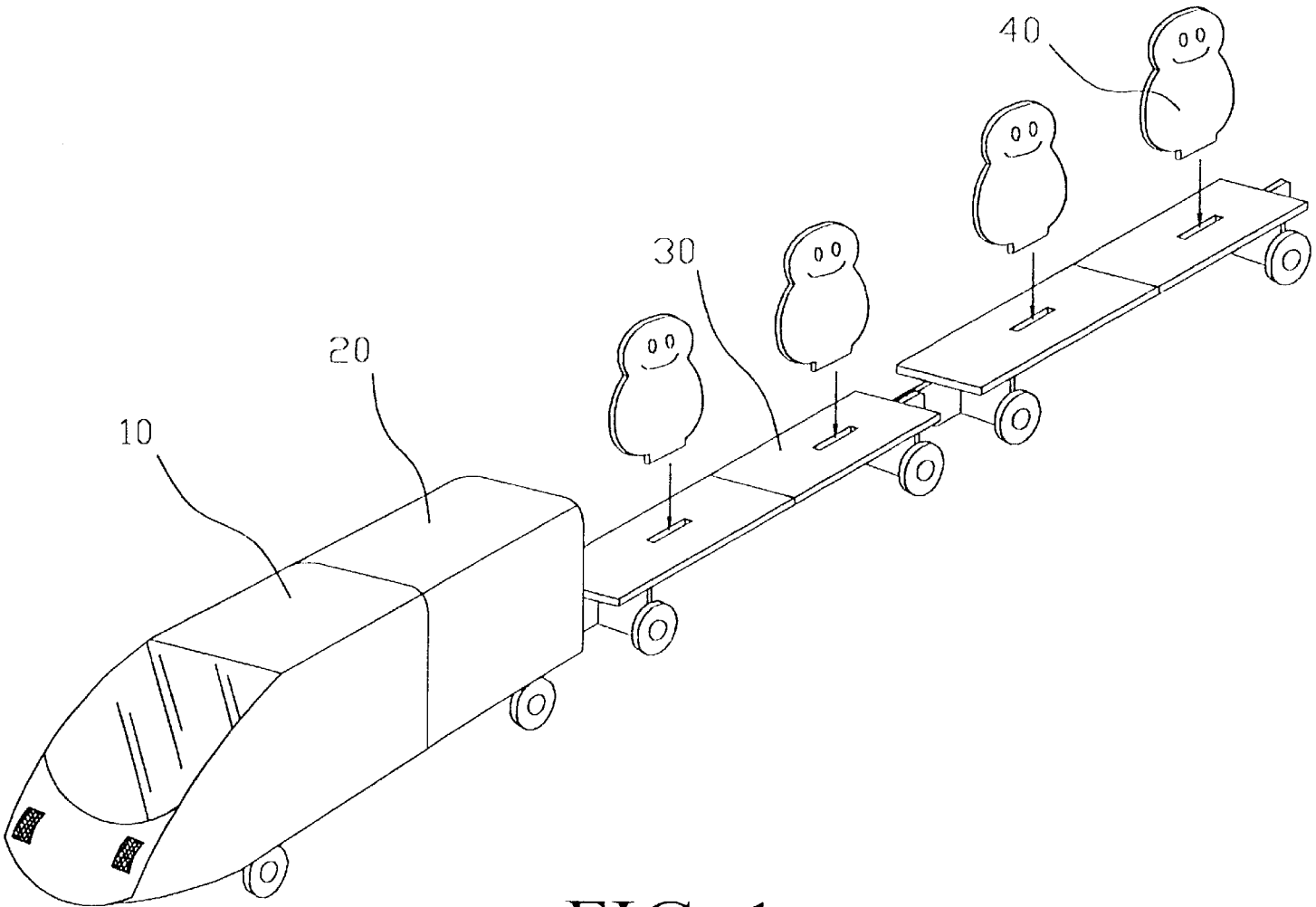
FIG. 1 is an assembled perspective view of a three-dimensional built-up toy train according to a preferred embodiment of the present invention.
Figure 2:
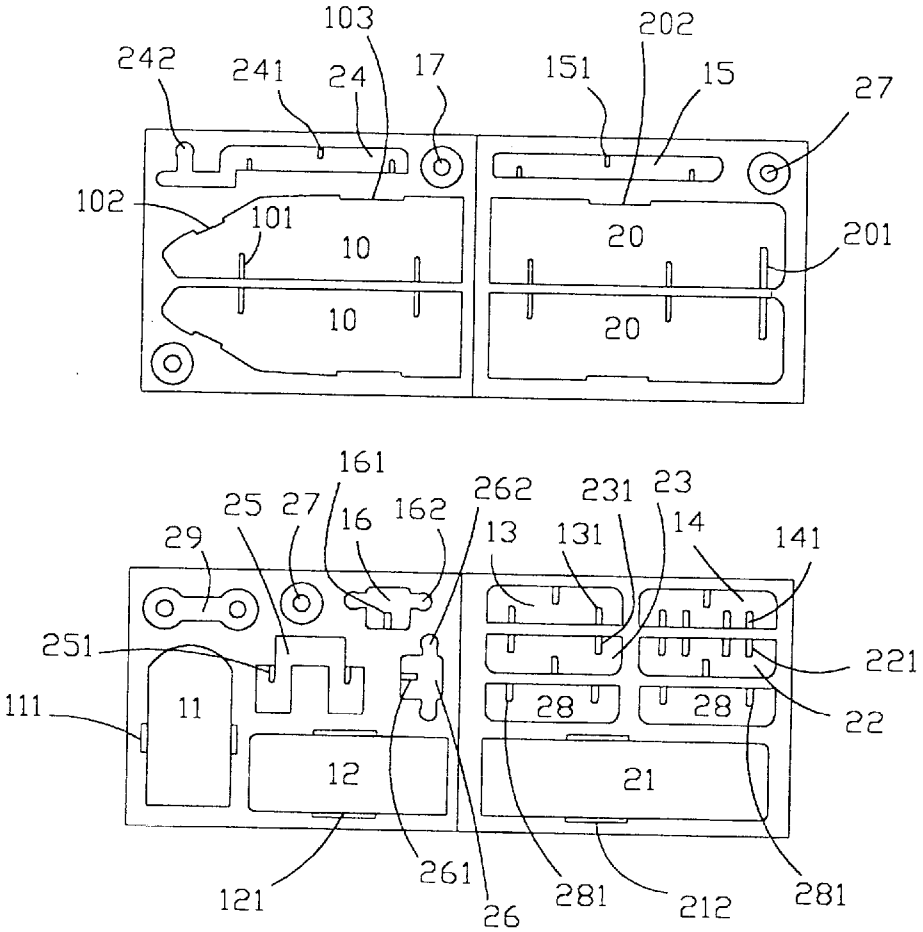
FIG. 2 shows various modeled flat parts are stamped on thin plates for assembling into a locomotive of the toy train of FIG. 1.
Figure 3:
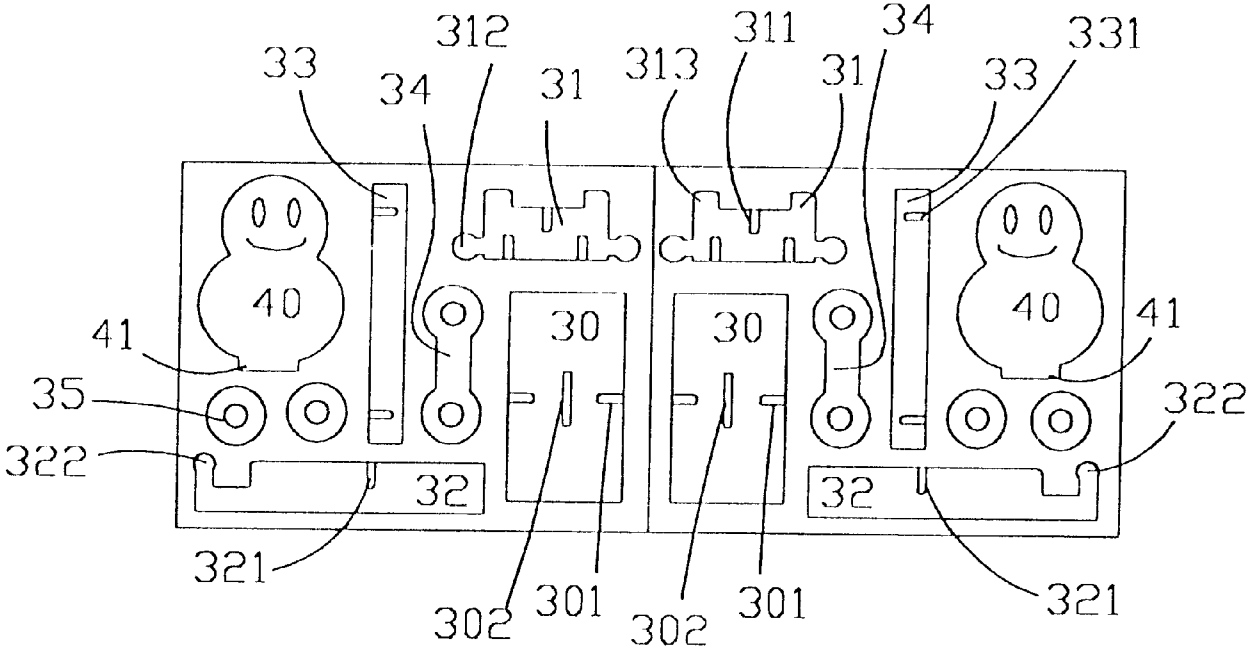
FIG. 3 shows various modeled flat parts are stamped on a thin plate for assembling into a two-section passenger car of the toy train of FIG. 1.
Figure 4:
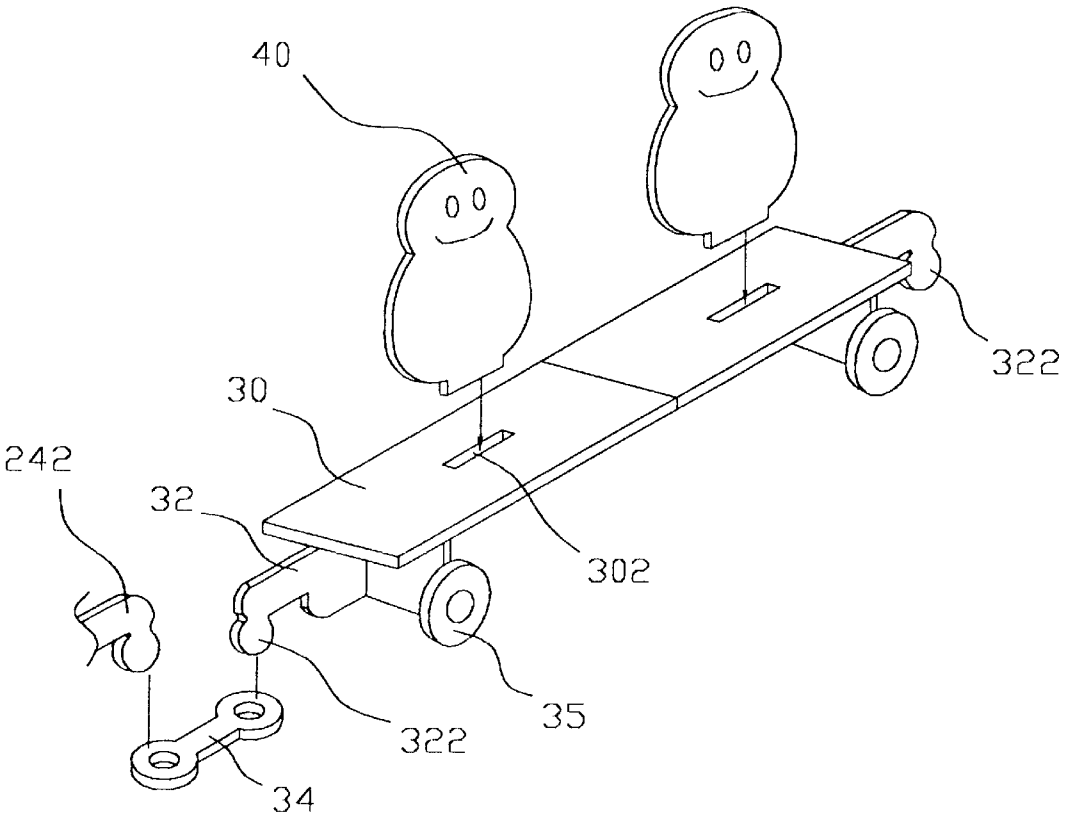
FIG. 4 is a perspective view of a two-section passenger car of the toy train of FIG. 1.

Please refer to FIG. 1 that is an assembled perspective view of a three-dimensional built-up toy train according to a preferred embodiment of the present invention. As can be clearly seen from FIG. 1, the entire toy train of the present invention is built up from a plurality of modeled flat parts that are directly stamped on thin plates, as shown in FIGS. 2, 3 and 4. The modeled flat parts could be assembled into a front locomotive 10, a back locomotive 20, a plurality of two-section passenger cars 30, and a plurality of toy passengers 40.

Please refer to FIG. 2. Each front locomotive 10 includes two front locomotive walls 10, each of which is a locomotive-shaped flat part having a beveled front edge. Each of the two front locomotive walls 10 is provided near front and rear ends of a straight lower edge with two slits 101, at the beveled front edge with a first recess 102, and on a straight upper edge at a predetermined position with a second recess 103. There are also flat parts for a windshield 11 and a front roof 12 that are provided at two lateral sides with two tabs 111, 121, respectively, adapted to engage with the first recesses 102 at the beveled front edges and the second recesses 103 at the upper edges, respectively, of the two front locomotive walls 10. A first front locating part 13 is provided on an upper edge near two outer ends with two slits 131 for engaging with the two front locomotive walls 10, and on a lower edge of the two central slit 131 for engaging with a supporting part 15. A second front locating part 14 is symmetrically provided on an upper edge near two outer ends with two pairs of slits 141 for engaging with the two rear slits 101 separately on the lower edges of the two front locomotive walls 10, and provided on a lower edge with a central slit 141 for engaging with the supporting part 15, too.

The supporting part 15 is provided on an upper edge with two spaced slits 151 for engaging with the central slits 131 and 141, and on a lower edge with a central slit 151 for engaging with a slit 161 at an upper side of a wheel holder 16. The wheel holder 16 is provided at a lower side with two sideward projected round heads 162 to rotatably support two round wheels 17.

Each back locomotive 20 includes two back locomotive walls 20, each of which is a flat part being provided on a lower edge with three spaced slits 201, and on an upper edge with a recess 202. There are also a flat part for a back roof 21 that is provided at two lateral sides with two tabs 212 adapted to engage with the two recesses 102 at the upper edges of the two back locomotive walls 20.

A first back locating part 22 is symmetrically provided on an upper edge near two outer ends with two pairs of slits 221 for engaging with the most front slits 201 on the lower edges of the two back locomotive walls 20, and provided on a lower edge with a central slit 221 for engaging with a link part 24. A second back locating part 23 is provided on an upper edge near two outer ends with two slits 231 for engaging with the middle slits 201 on the lower edges of the two back locomotive walls 20, and on a lower edge with a central slit 231 for engaging with the link part 24. A stopper part 25 is engaged at two upward opened slits 251 with the two rear slits 201 of the two back locomotive walls 20.

The link part 24 is provided on an upper edge near a front portion thereof with two spaces slits 241 for separately engaging with the central slits 221, 231 on the lower edges of the first and the second back locating parts 22, 23; on a lower edge of the front portion with a central slit 241 for engaging with a slit 261 on an upper side of a wheel holder 26; and on the lower edge of a rear portion of the link part 24 with a downward extended round head 242 for engaging with a ring-shaped end of a connector 29 or 34, of which another ring-shaped end is connected to one passenger car 30 as will described in more details later.

The wheel holder 26 is provided at a lower side with two laterally extended roundheads 262 to rotatably support two wheels 27 thereon.

Two coupling parts 28 are provided on a lower edge with two spaced slits 281 for separately engaging with two upper slits 141, 221 of the second front locating part 14 and the first back locating part 22.

Other connecting mechanisms for the back locomotive walls 20 are the same as that for the front locomotive walls 10.

Please refer to FIG. 3 that shows various parts for building up a two-section passenger car 30 of the toy train shown in FIG. 1. As shown, each two-section passenger car includes two floor parts 30, each of which being provided at two lateral sides with two side slits 301 for engaging with a wheel holder 31 and at a center with an axially extended insertion hole 302 for a toy passenger 40 to insert therein. Since there are two symmetrical sets of flat parts for forming the two-section passenger car 30, only one set of the flat parts is described herein.

The wheel holder 31 is provided on a lower side with two spaced slits 311 for separately engaging with a slit 331 provided on an upper edge at an end of a long coupling 33, on the lower side at two outer ends thereof with two laterally extended round heads 312 for rotatably supporting two wheel parts 35, on an upper side with a central slit 311 for engaging with a link part 32, and on the upper side at two outer ends thereof with two upward extensions 313 for engaging with the side slits 301 on the floor part 30.

The link part 32 is provided on a first end portion of a lower edge with a central slit 321 for engaging with the central slits 311 on the upper side of the wheel holder 31, and at an outmost end of a second portion of the lower edge with a downward extended round had 322 for engaging with an ring-shaped end of a connector 34, another ring-shaped end of which is engaged with the downward extended round head 242 of the link part 24.

Each long coupling 33 engaged at an end with one lower slit 311 of the wheel older 31 is provided on the upper edge at another end with another slit 331 for engaging with a lower slit 311 of another wheel holder 31 connected to a next passenger car 30, so as to couple two adjacent passenger cars 30.

To build up the three-dimensional toy train with the above-described flat parts, first connect the two front locomotive walls 10 to the first and the second front locating parts 13, 14 by engaging the two bottom slits 101 of the walls 10 with the upper slits 131, 141 of the locating parts 13, 14, so that the first front locating part 13 is located in front of the second front locating part 14. Then, connect the support part 15 to the two front locating parts 13, 14 by engaging the two spaced upper slits 151 of the supporting part 15 with the lower central slits 131, 141 of the two front locating parts 13, 14, and connect the wheel holder 16 to the supporting part 15 by engaging the upper slit 161 of the wheel holder 16 with the lower central slits 151 of the supporting part 15. Thereafter, the windshield 11 and the front roof 12 are connected to the front locomotive walls 10 by engaging the tabs 111, 121 of the windshield 11 and the front roof 12 are connected to the front locomotive walls 10 by engaging the tabs 111, 121 of the windshield 11 and the front roof 12 with the recesses 102, 103 of the front locomotive walls 10, respectively.

Then, connect the two back locomotive walls 20 to the first and the second back locating parts 22, 23 by engaging the most front and the middle bottom slits 201 of the two walls 20 with the upper slits 221, 231 of the two locating parts 22, 23, respectively, so that the first back locating part 22 is located in front of the second back locating part 23. The stopper part 25 is connected to the walls 20 by engaging the two slits 251 with the two rear slits 201 of the walls 20. Then, connect the link part 24 to the first and the second back locating parts 22, 23 by engaging the two upper slits 241 of the link part 24 with the lower central slits 221, 231 of the two back locating parts 22, 23, so that the downward extended round head 242 of the link part 24 is close to the stopper part 25. Thereafter, connect the wheel holder 26 to the link part 24 by engaging the upper slit 261 of the wheel holder 26 with the lower central slits 241 of the link part 24. Wheels 27 may be rotatably mounted onto the two laterally extended round heads 262 of the wheel holder 26 before the latter is connected to the link part 24. Finally, connect the back roof 21 to the two back locomotive walls 20 by engaging the two tabs 212 with the upper recesses 202 on the two walls 20, and connect the two coupling parts 28 to the second front locating part 14 and the first back locating part 22 by engaging the slits 281 with two upper slits 141, 221, respectively. At this point, a locomotive for the toy train is formed.

Next, assemble each section of the two-section passenger car 30 by rotatably mounting the two wheel parts 35 onto the laterally extended round heads 312 of the wheel holder 31, and engage the two upward extensions 313 of the wheel holder 31 with the two side slits 301 of the floor part 30. Then, connect the link part 32 to the wheel holder 31 by engaging the lower slit 321 of the link part 32 with the upper central slit 311 between the two upward extensions 313 of the wheel holder 31. Finally, connect the two coupling parts 33 to the wheel holder 31 by engaging two upper slits 331 at an end of the coupling parts 33 with the two lower slits 311 of the wheel holder 31. At this point, one section of the two-section passenger car 30 is formed. By engaging the upper slits 331 at another end of the two coupling parts 33 with the two lower slits 311 of another wheel holder 31 on a second section of the two-section passenger car 30, a two-section passenger car 30 is completed. The link parts 32 for the two-section passenger car 30 are so mounted that their downward extended round heads 322 are separately located at two opposite ends of the two sections of the passenger car 30.

The connectors 29 and 34 are used to connect the locomotive of the toy train to the fist two-section passenger car 30 and a preceding two-section passenger car 30 to a following two-section passenger car 30 by separately engaging two ring-shaped ends of each connector 29, 34 with the round heads 242, 322 of two adjacent link parts 24, 32 or two round heads 322 of two adjacent link parts 32.

The toy passengers 40 may be connected to the passenger car 30 by inserting a lower tab 41 of the toy passenger 40 into the central slit 302 of the floor part 30, as shown in FIG. 4. A player may employ his or her imagination and thinking ability to assemble the various flat parts in different ways into a toy train. Differently shaped toy passengers may be provided to increase the fun of the toy train. To create more fun, the toy passengers may be differently designed cartoon figures, or figures of famous performers or politicians.

Figure 5:
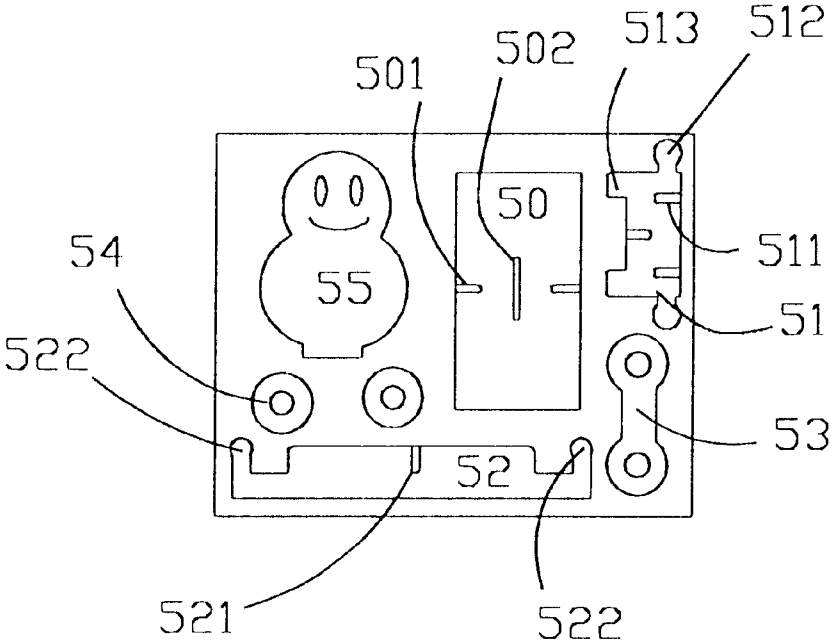
FIG. 5 shows various modeled flat parts are stamped on a thin plate for assembling into a one-section passenger car of the toy train of the present invention.

FIG. 5 shows another set of various flat parts for assembling into a second embodiment of the passenger car. The passenger car of this embodiment is a one-section passenger car and is built up from a flat floor part 50 having two side slits 501 and a central slit 502 for a toy passenger 55 to connect thereto; a wheel holder 51 being provided on a lower edge near two outer ends with two slits 511, on the lower edge at two outer ends with two laterally extended round heads 512, on an upper edge at two outer ends with two upward extensions 512 for engaging with the two side slits 501 of the floor part 50, and on the upper edge with a central slit 511; two wheel parts 54 rotatably mounted on the two round heads 512 of the wheel holder 51; a link part 52 being provided on a lower edge with a central slit 521 for engaging with the upper central slit 511 of the wheel holder 51 and on the lower edge at two outer ends with two downward extended round heads 522; and a connector 53 having two ring-shaped ends for separately engaging with round heads 522 of two link parts 52 of a preceding and of a following passenger car 50, so as to serially connect two passenger cars 50.

What is claimed is:

1. A three-dimensional built-up toy train, comprising a plurality of modeled flat parts directly stamped on a thin plate for assembling into a front locomotive, a back locomotive, and a plurality of two-section passenger cars;

said modeled flat parts for assembling said front locomotive including two front locomotive walls, a windshield, a front roof, a supporting part, a first front locating part, a second front locating part, a wheel holder, and two wheels; and said flat parts for assembling said front locomotive being provided at predetermined depths to enable said flat parts to connect to one another through engagement of said slits with one another indifferent ways;

said modeled flat parts for assembling said back locomotive including two back locomotive walls, a back roof, a link part, a stopper part, a first back locating part, a second back locating part, a wheel holder, and two wheels; and said flat parts for forming said back locomotive being provided at predetermined positions with slits having predetermined depths to enable said flat parts to connect to one another through engagement of said slits with one another in different ways; and said modeled flat parts for forming each of said two-section passenger car including two floor parts, two coupling parts, two link parts, two wheel holders, four wheels, and a plurality of toy passengers; and said flat parts for forming each of said two-section passenger car being provided at predetermined positions with slits having predetermined depths to enable said flat parts to connect to one another through engagement of said slits with one another in different ways;

whereby a player is trained to employ imagination and thinking ability in the process of assembling said a plurality of modeled flat parts into said toy train through engagement of said slits with one another in different ways.

2. The three-dimensional built-up toy train as claimed in claim 1, wherein each of said wheel holders includes two laterally extended round heads, and said wheels are separately rotatably mounted on said round heads, enabling said toy train to move forward with said wheels rotating relative to said wheel holders.

3. The three-dimensional built-up toy train as claimed in claim 1, wherein said toy passengers are differently designed figures.

* * * * *